US011925282B2

(12) United States Patent
Westhoven

(10) Patent No.: US 11,925,282 B2
(45) Date of Patent: Mar. 12, 2024

(54) MULTI-FUNCTIONAL COVER FOR TRAY TABLES

(71) Applicant: Forum Brands, LLC, New York, NY (US)

(72) Inventor: Nicholas Westhoven, New York, NY (US)

(73) Assignee: Forum Brands, LLC, New York, NY (US)

( * ) Notice: Subject to any disclaimer, the term of this patent is extended or adjusted under 35 U.S.C. 154(b) by 0 days.

(21) Appl. No.: 18/481,412

(22) Filed: Oct. 5, 2023

(65) Prior Publication Data

US 2024/0023735 A1 Jan. 25, 2024

(51) Int. Cl.
*A47G 11/00* (2006.01)
*A45F 5/00* (2006.01)

(52) U.S. Cl.
CPC ..... *A47G 11/004* (2013.01); *A45F 5/00* (2013.01); *A45F 2005/002* (2013.01); *A45F 2200/0525* (2013.01)

(58) Field of Classification Search
CPC ... A47G 11/004; A45F 5/00; A45F 2005/002; A45F 2200/0525
USPC ..... 108/43, 44, 90
See application file for complete search history.

(56) References Cited

U.S. PATENT DOCUMENTS 2,637,136 A * 5/1953 Mark ..... A63F 1/06 108/90
3,310,091 A * 3/1967 Geisen ..... A47G 11/004 108/90
4,500,129 A * 2/1985 Hahn ..... A01G 9/04 383/4
4,574,990 A * 3/1986 Remis ..... A45C 3/00 224/155
4,777,992 A * 10/1988 Olger ..... A47G 11/003 206/541
5,695,240 A * 12/1997 Luria ..... B64D 11/0636 297/163
5,878,672 A * 3/1999 Ostermann ..... B60N 3/004 297/188.06

(Continued)

FOREIGN PATENT DOCUMENTS

BR MU8902277 U2 * 6/2011
EP 3289927 A1 * 3/2018

(Continued)

*Primary Examiner* — Hanh V Tran
(74) *Attorney, Agent, or Firm* — Tatonetti IP

(57) ABSTRACT

A two-piece multi-functional tray table cover is configured with a flexible sleeve and water-resistant prop-up tray to simultaneously provide a hygienic barrier to the tray table's surface, and a dedicated play, work, or otherwise use area for a user to place their toys, drinks, food, etc. The sleeve is comprised of a spandex material to enable a user to stretch the fabric around various-sized tray tables to accommodate different manufacturers, airlines, etc. The sleeve has a hook and loop fastener, such as Velcro®, on the top side, which attaches to a corresponding hook and loop fastener on the prop-up tray. In addition, the bottom side of the sleeve, opposite the top side with the hook and look fastener, has at least a pocket with a transparent window that enables a user to view a computing device's screen or other contents.

18 Claims, 12 Drawing Sheets

(56) References Cited

U.S. PATENT DOCUMENTS 5,979,337 A * 11/1999 Clark ..... A47B 23/002 248/444
6,240,667 B1 * 6/2001 Harney ..... G09F 21/049 108/90
6,986,308 B1 * 1/2006 King ..... A47G 23/0608 108/43
7,104,201 B2 * 9/2006 Comeaux ..... A61B 50/13 108/90
7,971,929 B2 * 7/2011 Kennard ..... B64D 11/0638 297/146
7,976,099 B2 * 7/2011 Ferrara ..... B60N 3/002 297/135
8,635,959 B1 * 1/2014 Silknitter ..... A47G 23/0608 108/43
9,051,087 B1 6/2015 Daniels
9,295,603 B1 * 3/2016 Selnow ..... A47G 11/004
9,403,464 B2 * 8/2016 Valcic ..... B60R 7/043
9,549,606 B1 * 1/2017 Casadesus ..... F41H 1/00
9,643,727 B2 5/2017 Dall'Era et al.
10,112,360 B2 10/2018 Casagrande
2001/0039903 A1 * 11/2001 Patterson ..... B60N 3/004 108/44
2006/0169731 A1 * 8/2006 Matulewic ..... A63B 57/00 224/684
2009/0223418 A1 * 9/2009 Ferrara ..... B60N 3/004 108/14
2010/0015882 A1 * 1/2010 Givens ..... A63H 33/006 446/227
2011/0013856 A1 * 1/2011 Gilbert ..... A63H 33/006 383/4
2012/0308164 A1 * 12/2012 Hudson ..... H04M 1/04 383/98
2014/0377480 A1 * 12/2014 Davino ..... B64D 11/0638 428/12
2014/0377499 A1 * 12/2014 Davino ..... B64D 11/0638 428/99
2015/0111626 A1 * 4/2015 Bell ..... G06F 1/1637 455/575.8
2015/0175081 A1 * 6/2015 Rodriguez ..... A45C 7/0077 224/275
2016/0183392 A1 * 6/2016 Kelley ..... H04B 1/3877 211/26
2017/0071375 A1 * 3/2017 Smith ..... B64D 11/0638
2017/0291710 A1 * 10/2017 Barr-Perea ..... B61D 33/0007
2019/0159579 A1 * 5/2019 Picking ..... A45F 5/021
2021/0145193 A1 * 5/2021 Presley ..... B60N 3/004

FOREIGN PATENT DOCUMENTS

WO WO-2011160032 A1 * 12/2011 ..... B60N 3/004
WO WO-2014052683 A1 * 4/2014 ..... A45C 11/00

* cited by examiner

Foldable for easier clean-up

MULTI-FUNCTIONAL COVER FOR TRAY TABLES

BACKGROUND

Tray tables that provide people a place to put their food, drinks, paperwork, laptops, etc., are often plagued with hygienic, organizational, and tidiness challenges. These tray tables may be most apparently present in transportation locales, such as airplanes, airports, trains, and waiting areas, but other places may also have tray tables to provide people a place to station themselves. These tray tables are often touched by many people, such as passengers, and are capable of harboring germs. Many travelers seek to protect themselves and their children from exposure to such germs. Young children with less-developed immune systems may be particularly vulnerable to sickness from tray table germs.

In addition, organizational and tidiness problems may occur for children and adults on long-distance travel. Adults may attempt to bring toys, coloring books, crayons, tablets, etc., for their child's use on a flight or train, but these items may be difficult to keep organized and used with a tray table. Even more, the adult may simply forget to bring such items without having a dedicated tool. Furthermore, spills and messes are inevitable on the tray tables, making traveling even more stressful, especially for parents of young children.

SUMMARY

A two-piece multi-functional tray table cover is configured with a flexible sleeve and water-resistant prop-up tray to simultaneously provide a hygienic barrier to the tray table's surface, and a dedicated play, work, or otherwise use area for a user to place their toys, drinks, food, etc. The entire tray table cover can easily roll up and stay in such a position using a nylon strap that extends around the entire rolled-up cover. When unraveled, the sleeve can attachably disengage from the prop-up tray.

The sleeve is comprised of a spandex material to enable a user to stretch the fabric around various-sized tray tables to accommodate different manufacturers, companies, airlines, etc. The sleeve has a hook and loop fastener, such as Velcro®, on the top side, which attaches to a corresponding hook and loop fastener on the prop-up tray's bottom side. In addition, on the bottom side of the sleeve, opposite the top side with the hook and look fastener, there may be one or more pockets for storing various items, such as toys, tablets, phones, pencils, etc. A front pocket on the bottom side has a transparent window to enable, for example, a user to watch multimedia videos while the sleeve is attached to the tray table and the tray table is propped upward against the seat in front of the user.

Once attached to the sleeve's hook and loop fastener, the prop-up tray leverages a water-resistant material on at least its top surface to maintain a clean area and, should a spill occur, make clean-up easier and contained. Sets or pairs of buttons are positioned adjacent to the top side of the prop-up tray's corners. The buttons adjacent to each other on each corner attach, which causes the sides of the prop-up tray to prop up at a substantially 90° angle, thereby creating an exterior boundary and a dedicated use area, such as a play area for a child. Essentially, mating each corner's button pairs creates side walls that operate as a perimeter-boundary to the prop-up tray. Once each corner of the prop-up tray's buttons is engaged, all four sides are propped upward and may approximately form an orthogonal angle relative to the base resting against a table's surface. In other implementations, however, acute or obtuse angles may be established between the propped-up side walls and the base resting against a flat surface.

Should a spill occur on the prop-up tray's surface, the user can easily detach the prop-up tray from the sleeve and fold it to, for example, discard the liquid or other contents into a garbage can. Since the prop-up tray is liquid-resistant and the side walls have been propped upward via the button attachments, the liquid is contained within that designated area. Furthermore, the user can remove the prop-up tray and close the tray table upward while the sleeve is still attached, thereby exposing the transparent pocket and enabling the user to, for example, watch a television show, movie, etc.

This Summary is provided to introduce a selection of concepts in a simplified form that is further described below in the Detailed Description. This Summary is not intended to identify key features or essential features of the claimed subject matter, nor is it intended to be used as an aid in determining the scope of the claimed subject matter. Furthermore, the claimed subject matter is not limited to implementations that solve any or all disadvantages noted in any part of this disclosure. These and various other features will be apparent from a reading of the following Detailed Description and a review of the associated drawings.

DESCRIPTION OF THE DRAWINGS

Like reference numerals indicate like elements in the drawings. Elements are not drawn to scale unless otherwise indicated.

DETAILED DESCRIPTION

Figure 1:
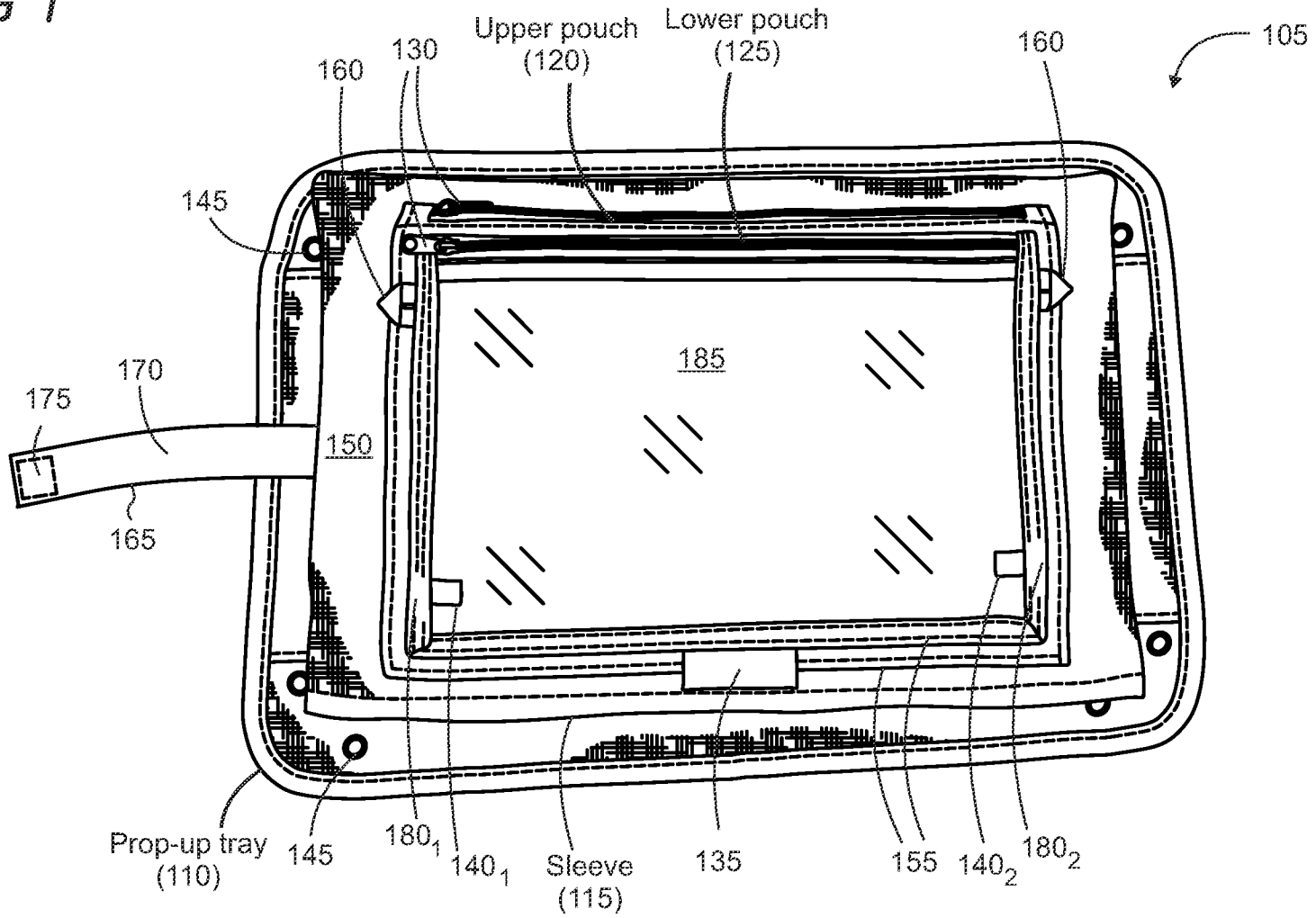
FIG. 1 shows an illustrative representation of a bottom side of a tray table sleeve having various pockets to store items.

FIG. 1 shows an illustrative representation in which a tray table cover 105 has a sleeve 115 and a prop-up tray 110, providing a hygienic barrier to a tray table while also providing a use area on which a user can place items, such as drinks, toys, etc. The sleeve's body 150 is comprised at least partially of a spandex material, which enables the sleeve's stretchability. In some implementations, the body is comprised of a combination of polyester and spandex, but other stretchable material is also possible. The upper and lower pouches 120, 125 are sewn to the body to provide additional functionality to the tray table cover 105, as discussed in greater detail below.

The bottom side of the sleeve is shown in FIG. 1, which has an upper pouch 120 and a lower pouch 125, each accessible via respective zippers 130. The pouches have their own distinct layers relative to the sleeve's body 150, and the pouch's body 155 may be comprised of a polyester material that is relatively more sturdy and less elastic than the sleeve's body 150. While a zipper is shown in FIG. 1, other closure mechanisms, such as buttons, hook and loop fasteners (e.g., Velcro®), are also possible.

The lower pouch 125 leads to the front-most pocket with a transparent exterior film 185, such as PVC (polyvinyl chloride), allowing a user to view its contents. Such transparency can be useful to see what items are currently in the pouch and, in some implementations, enable a user to watch a video (e.g., movie, show, etc.) on their smartphone or tablet computer while stored within the lower pouch. The transparent exterior film may also permit the user to operate a device's touch screen through the transparent exterior film without needing to remove the device from the pocket. In that regard, the exterior film still allows user-input without interference. The upper pouch 120 is positioned behind the lower pouch, and a layer or barrier separates the two pouches, such as polyester. Attached toward a bottom of the pouch's body 155 is a base 135 having a top surface with a hook and loop fastener, which is used to at least partially seal shut the opening on that side of the sleeve 115 (not shown in FIG. 1), which is discussed in greater detail below. While two pouches are shown in the drawings, additional or fewer pouches/pockets are also possible, such as a single pouch having the transparent film, three or more pouches, and potentially sub-pockets within pouches.

The lower pouch also has two openings 180, indicated to the user by tags 140, which provide access to the lower pouch's interior. The openings are created by a gap in the stitching that seals the transparent exterior film 185 to the pouch's body. The openings 180 may provide, for example, a place for a user to stick their charging cord, wired headphones, etc. A nylon loop 160 is also attached to the pouch's body to provide an additional hook for various use scenarios, such as attaching the tray table cover 105 to a user's keychain, luggage, gym bag, etc.

Underneath the sleeve 115 in FIG. 1 is a prop-up tray 110. The prop-up tray may be comprised of water-resistant material to enhance the user's experience with the product when in use, as discussed in greater detail below. For example, the prop-up tray may be comprised of a 600D polyester with a hydrophobic coating. Other materials suitable for at least some of the purposes discussed herein are also possible, such as woven or nonwoven polyester, nylon, cotton, bamboo, or other fabric. The rear side of the buttons 145 is shown on the corners of the prop-up tray. A nylon strap 165 is attached to the prop-up tray 110 and extends outward to enable a user to roll up the entire tray table cover 105, such as into a cylindrical shape, and then wrap the strap around the cover. The strap has a hook and loop fastener 170 on both sides thereof to enable a user to wrap the strap around the cover in either direction. The corresponding hook and loop fastener 175 is positioned on the distal end, and each side of the strap engages with the fastener 170.

Figure 2:
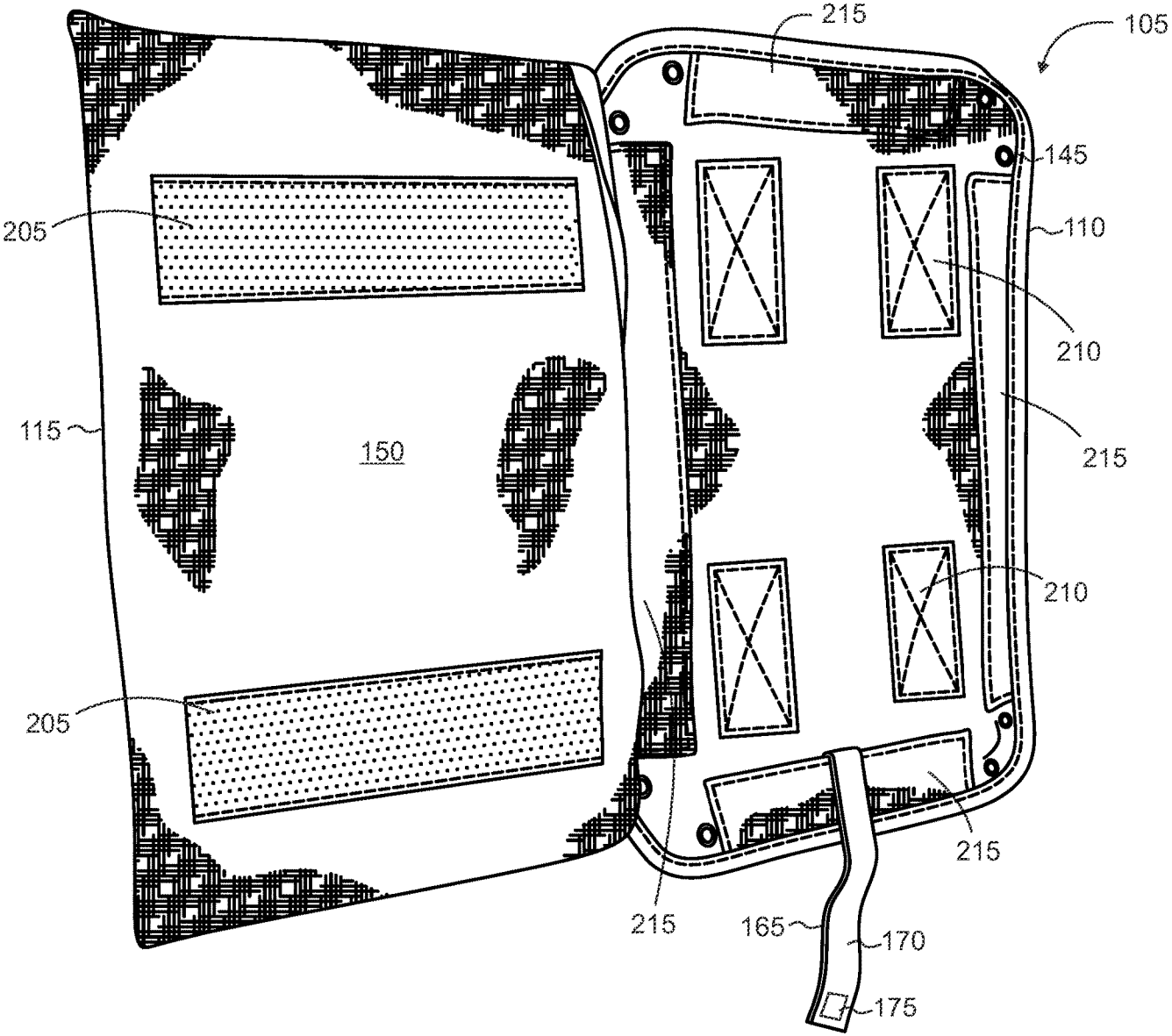
FIG. 2 shows an illustrative representation of the sleeve's top side's hook and loop fastener, which engages with a prop-up tray's bottom side's corresponding hook and loop fastener.

FIG. 2 shows an illustrative representation of the sleeve's top side, which primarily exposes the sleeve's body 150, comprised of elastic material. Patches of hook and loop fasteners 205 are stitched into the body, which a corresponding hook and loop fastener 210 on the prop-up tray 110 detachably connects. In typical implementations, the top side of the sleeve 115 exposes the fastener 205 and the corresponding fastener 210 on the prop-up tray's bottom side, shown in FIG. 2, is positioned to engage with the sleeve. The placement of the fasteners enables proper mating of the prop-up tray to the sleeve, even when the sleeve is stretched when installed on a relatively wide tray table. In the present implementation, the sleeve's hook and loop fasteners may be 7.25 inches long and are stitched into the sleeve via, for example, a box x stitch, and the fasteners are approximately six inches apart from each other. While stitching is used herein, other methods, such as adhesive, are also possible to attach the fasteners to the sleeve. In the present implementation, the prop-up tray's fasteners 210 are comprised of four two-inch wide patches attached to the tray's body (e.g., polyester with hydrophobic coating) via box x stitches, approximately 3.6 inches long, and spaced apart 4.75 inches laterally and 2.5 inches longitudinally.

Reinforcement materials are stitched into the prop-up tray's fabric to provide additional support to the side walls, as explained in greater detail below. For example, the reinforcements 215 may be EPE (expanded polyethylene) stitched into the prop-up tray's water-resistant material, such as polyester with a hydrophobic coating. In this regard, the reinforcements are essentially restricted to internal pockets within the prop-up tray. As shown in FIG. 2, the strap 165 is attached to the prop-up tray where the stitching is for one of the reinforcements.

Figure 3:
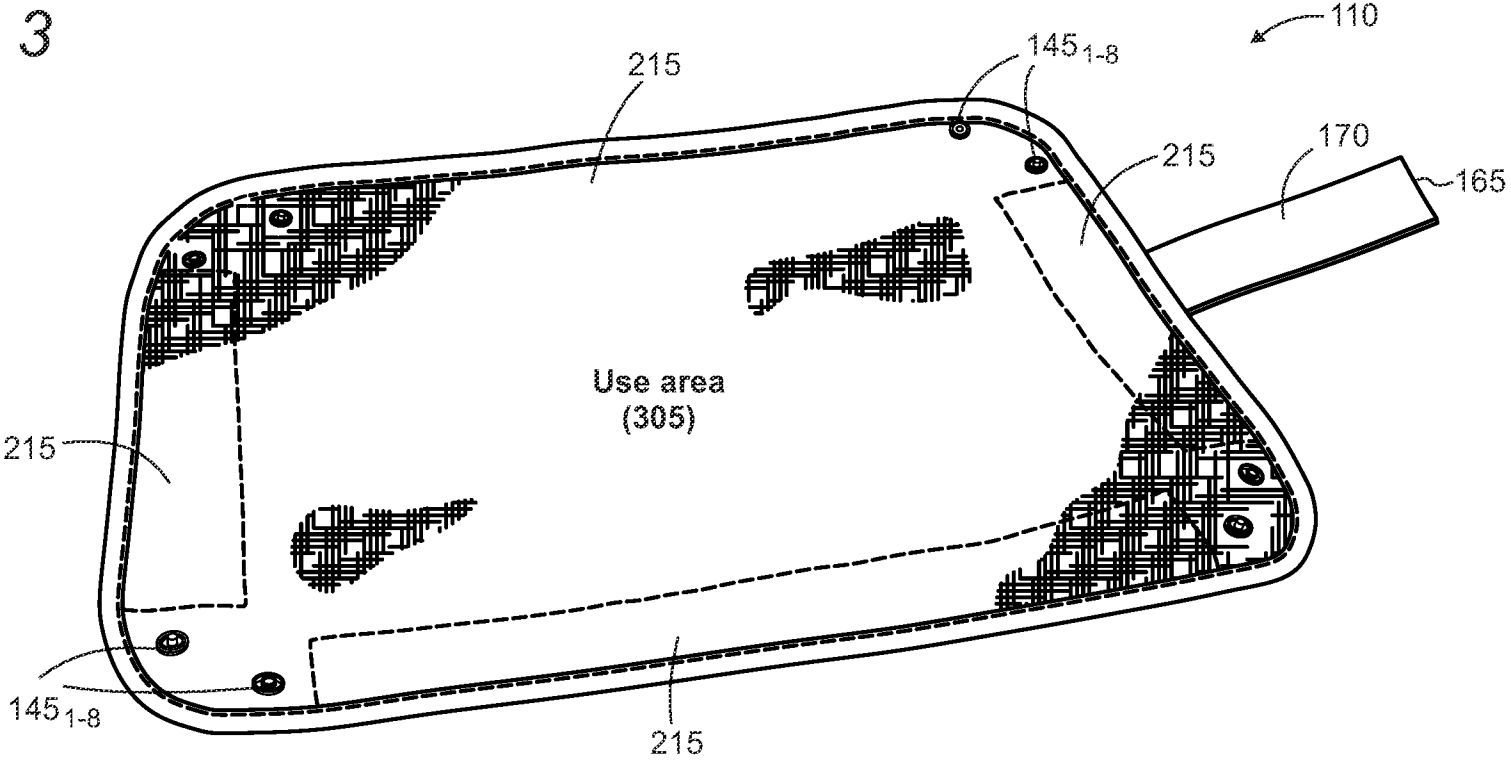
FIG. 3 shows an illustrative representation of the prop-up tray's water-resistant top surface.

FIG. 3 shows an illustrative representation in which the top side of the prop-up tray 110 has pairs of buttons on each corner. The buttons have been strategically placed at the corners, and each pair connects, as discussed in greater detail below. The prop-up tray's central area or region is the use area 305, where users can place and use various items, such as toys, coloring books, smartphones, work documents, journals, etc.

Figure 4:
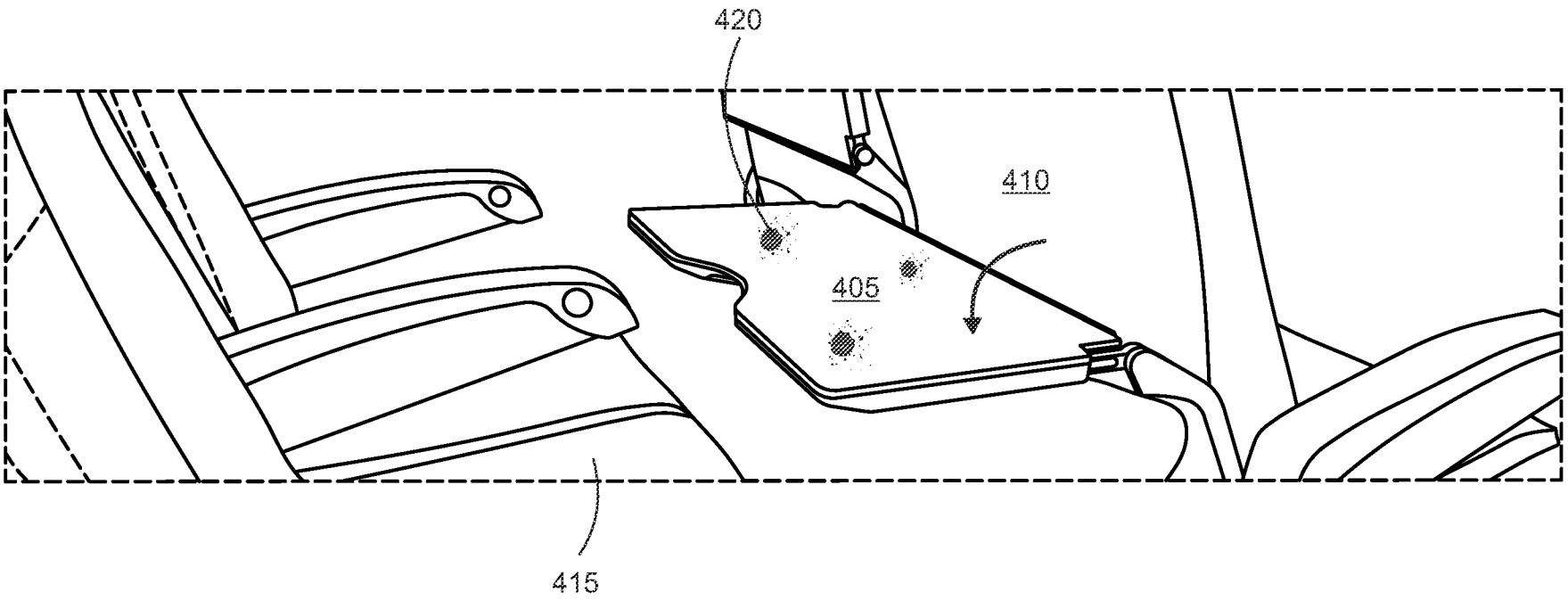
FIG. 4 shows an illustrative environment of an airplane's seating area with a tray table folded downward for use.

FIG. 4 shows an illustrative environment in which an airplane's setup includes a user's personal seat 415, tray table 405, and front seat 410 (i.e., the seat in front of the user's). The tray table, in a down or use position, has various germs and stains 420 on its surfaces, which is often a concern parents have for their children, and all people, in general, feel uneasy about whenever traveling. While an airplane setup is shown and discussed herein, the tray table cover 105 discussed herein may work on any public or other table, such as on trains, buses, waiting areas, and other scenarios related to or unrelated to transportation.

Figure 5:
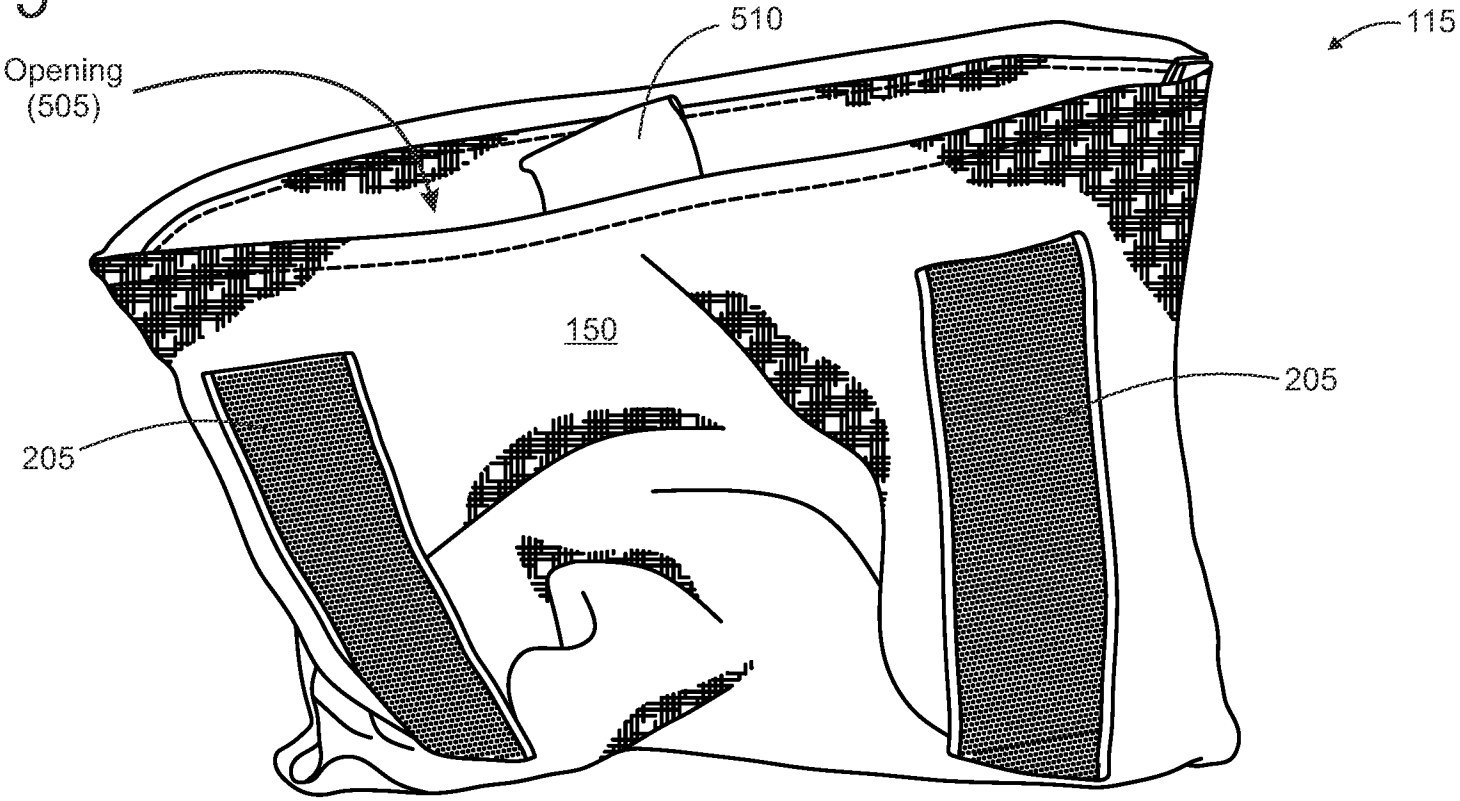
FIG. 5 shows an illustrative representation of the sleeve's tray table opening that wraps around a tray table.

FIG. 5 shows an illustrative representation of an opening 505 on the sleeve's body 150. The opening 505 is opposite the access points to the upper and lower pouches 120, 125 (FIG. 1). The opening is adapted to be shaped and sized to fit a range of tray tables 405 to accommodate various manufacturers, companies, etc. In typical implementations, the sleeve may be 14.25 inches wide and 10 inches deep, but other sizes smaller or larger than those are also possible, depending on the scenario. For example, tray tables are typically 14-17 inches wide, 8-10 inches deep, and 0.5-1 inch thick. The flexible fabric and overall size of the sleeve 105 accommodate at least these ranges of tray tables, but larger or smaller sleeves are also possible, depending on the implementation. For example, a similar configuration tray table cover 105 may be adapted to work on a student's desk at school or university. The top of the sleeve's opening may be hemmed to enhance the product's durability and appearance. Sewn into the sleeve hem is a closing nylon strap 510, with a hook and loop fastener on its surface, that engages with the base 135 on the opposite end of the sleeve (FIG. 1).

Figure 6:
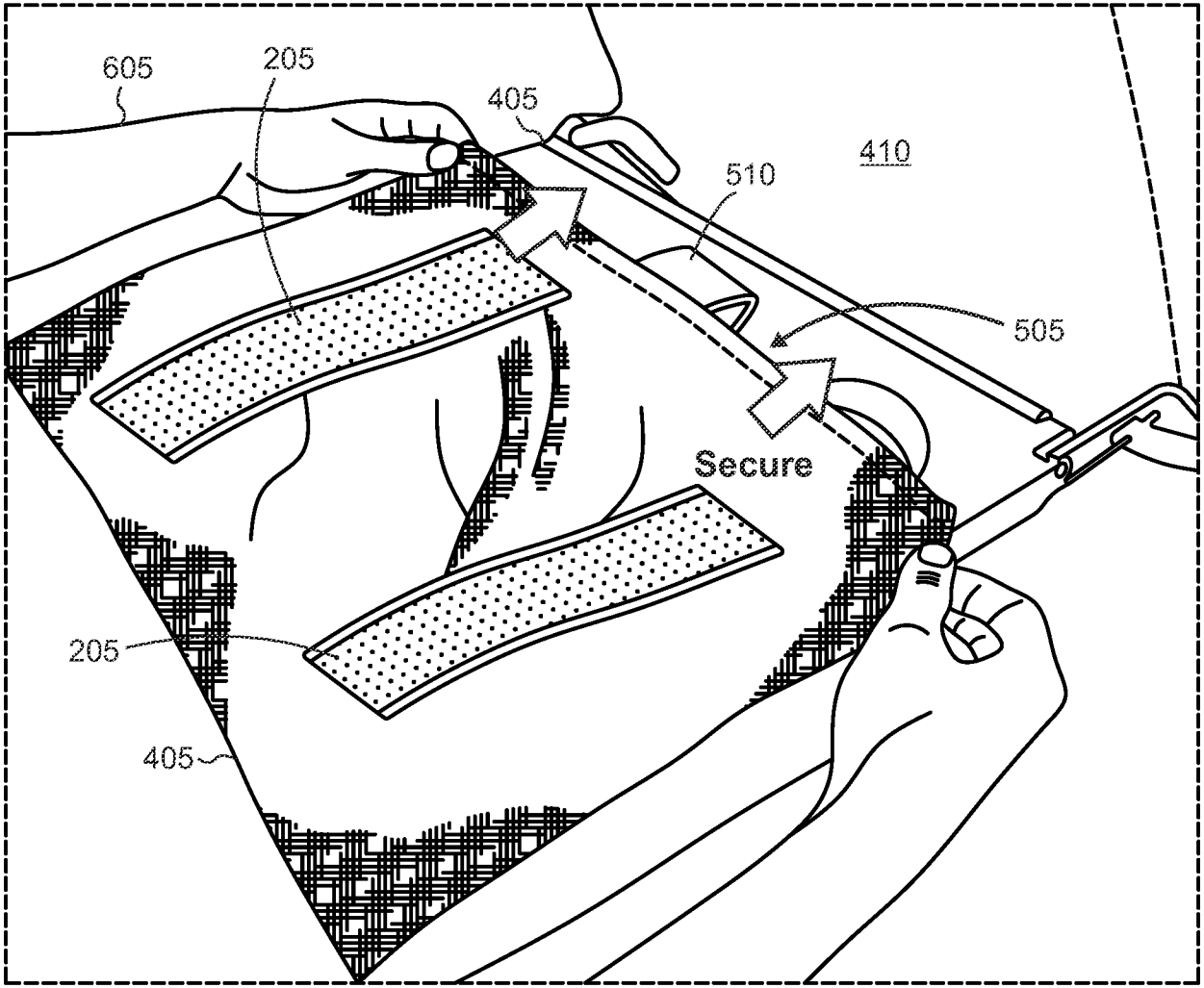
FIG. 6 shows an illustrative environment in which a user secures the tray table into the sleeve's tray table opening.

FIG. 6 shows an illustrative representation in which the sleeve 115 is secured to and at least partially encapsulates the tray table 405 while it is in a down or use position. The sleeve's opening 505 is maneuvered and propped around the tray table. The user 605 can manipulate the sleeve's elastic ability to fit around larger tray tables. Furthermore, The closure of the opening 505 using the closing strap 510 and base 135 can help tighten the sleeve onto the tray table, smaller or otherwise, thereby providing a snug fit. In typical implementations, the user makes the fasteners 205 exposed on the top side of the tray table so the prop-up tray 110 can attach thereto.

Figure 7:
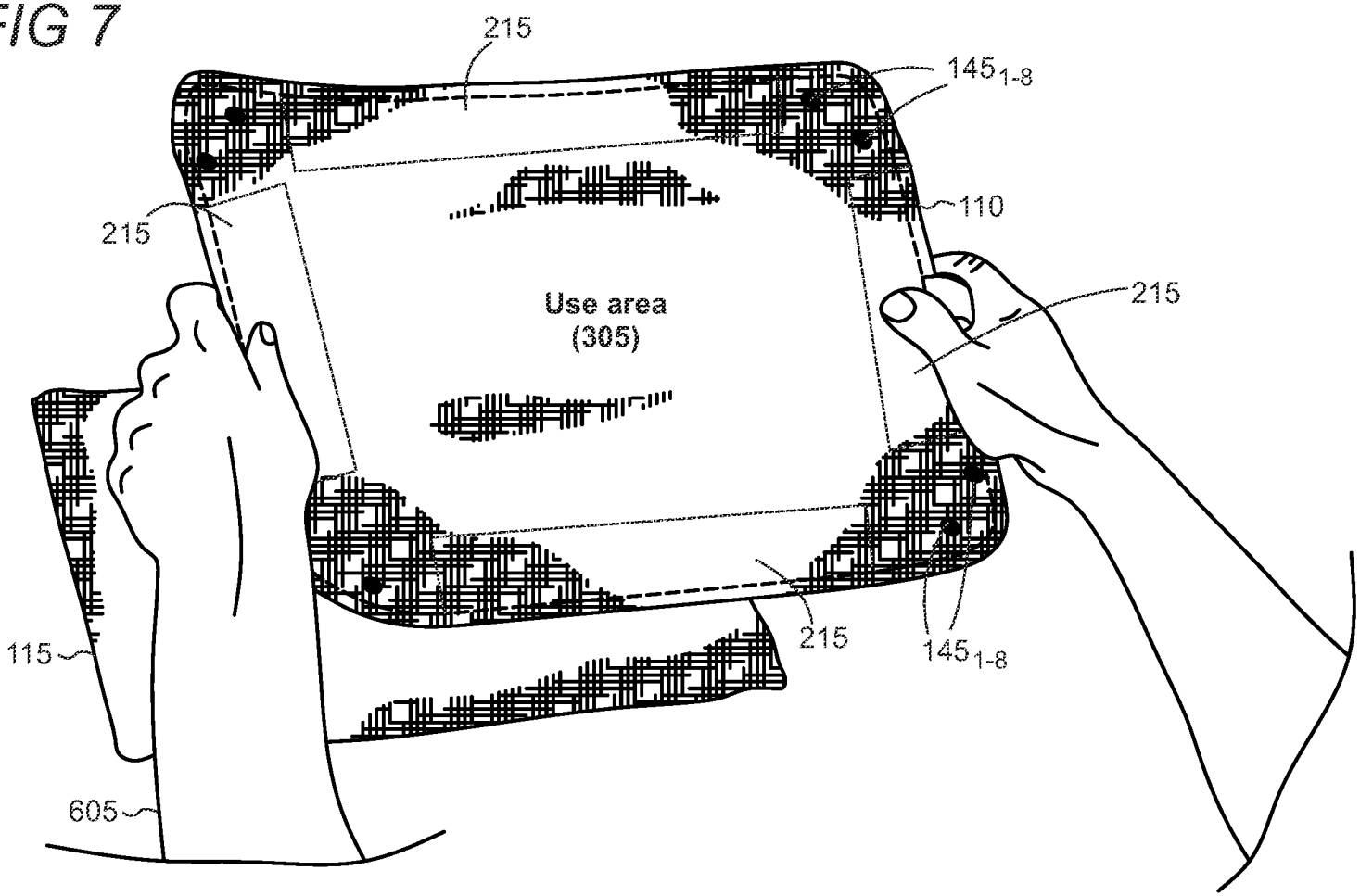
FIG. 7 shows an illustrative representation in which the user attaches the prop-up tray's bottom surface's fastener to the sleeve's top side fastener.

FIG. 7 shows an illustrative representation in which the user 605 aligns the prop-up tray's bottom fasteners 210 (FIG. 2) with the upper fasteners 205 on the sleeve 115. In connecting the prop-up tray 110 to the sleeve 115, the use area 305 is exposed on the top side of the tray table 405 for the user's enjoyment and use.

Figure 8:
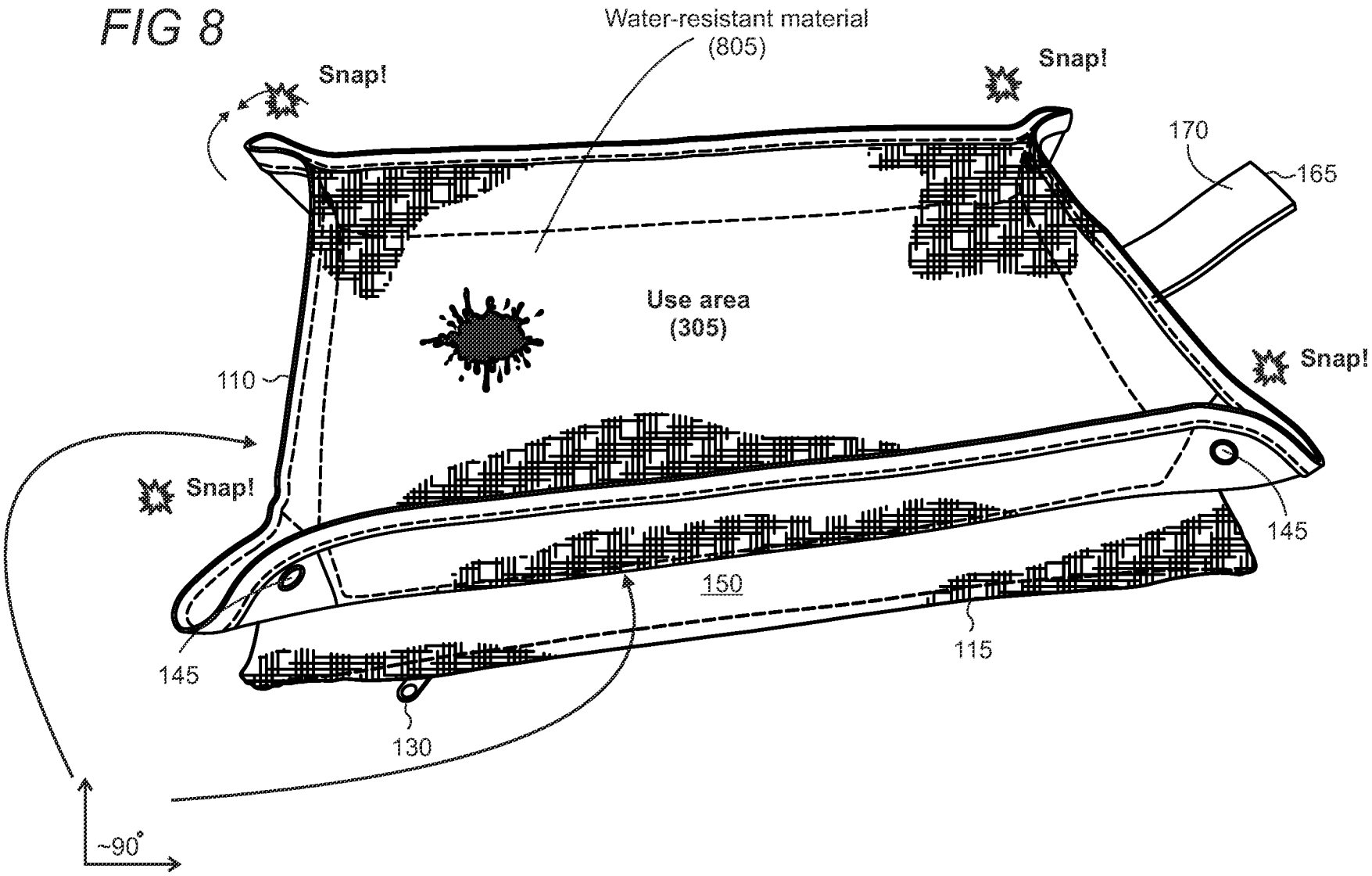
FIG. 8 shows an illustrative representation of the prop-up tray's corner buttons attaching and thereby propping up its side walls to create a use area.

FIG. 8 shows an illustrative representation in which the prop-up tray 110 is attached to the sleeve 115. Each pair of buttons 145 on the corners connect to each other in a connector-receptacle configuration, which props up surrounding side walls on each side of the prop-up tray. While only four sides are shown herein, alternative configurations are also possible, such as three sides, five sides, etc., in which case an adjusted and suitable number of button pairs would be implemented at corners similar to the design herein. Also, while pairs of buttons are shown, other sets of fasteners or other connection mechanisms may be used, such as magnets, tab and notch, hook and loop fasteners, etc. Multiple pairs or sets of fasteners may also be used at the corners to provide a reinforced structure—such as two pairs of buttons (four total) on one corner.

As shown in FIG. 8, the propped-up side walls can form a substantially 90° angle once the buttons are connected together. In other embodiments, the side walls may be propped up at an acute or obtuse angle relative to the prop-up tray's plane resting on a table's surface, depending on the implementation. The side walls create additional protection to spills leaking beyond the prop-up tray and maintain items in the use area 305. The prop-up tray, or at least the upper surface of the prop-up tray, is comprised of a water-resistant material 805, such as polyester with a hydrophobic coating.

Figure 9:
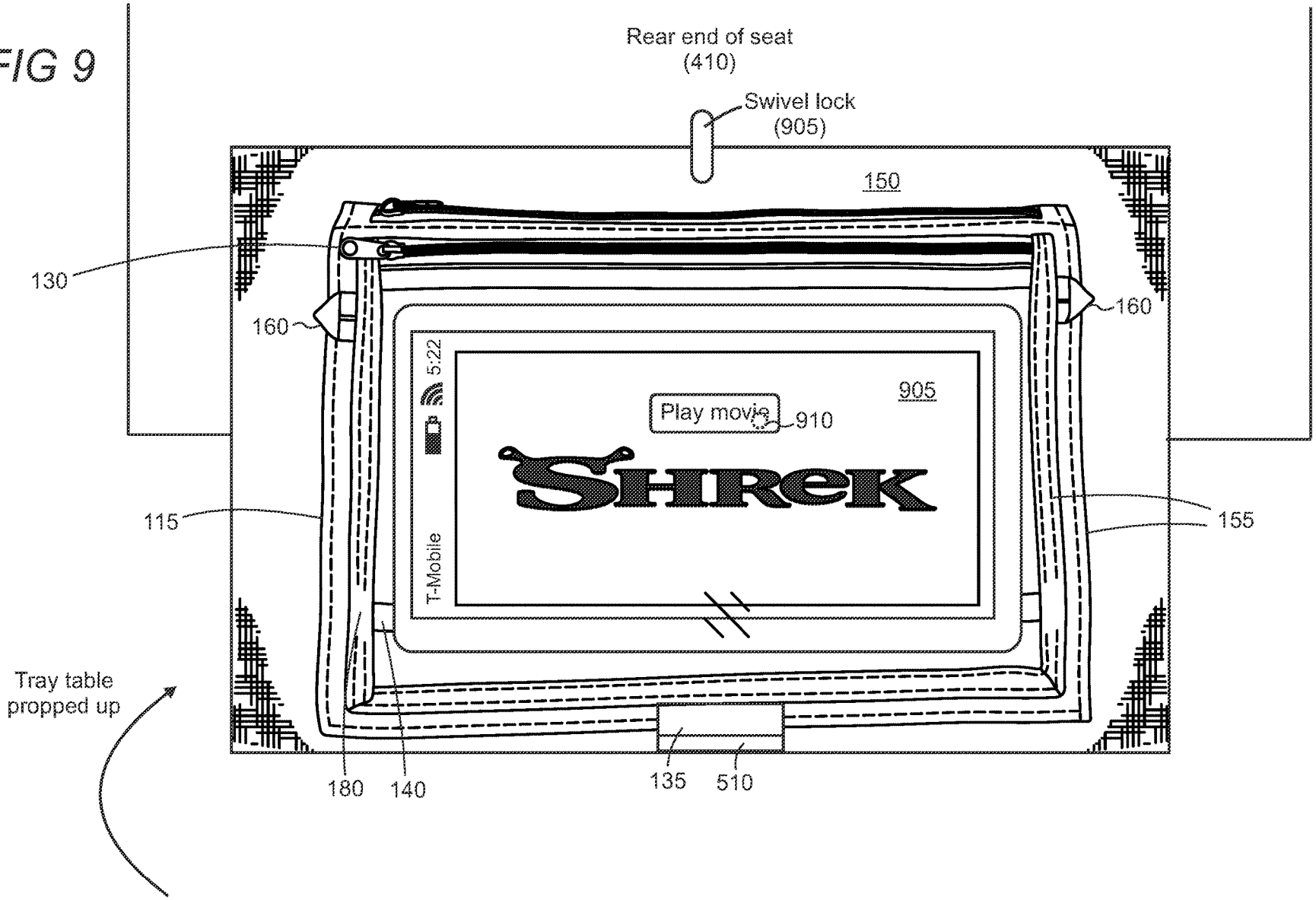
FIG. 9 shows an illustrative representation of the tray table in a closed position and a computing device exposed through a pouch's transparent film, enabling a user to watch a video.
Figure 10:
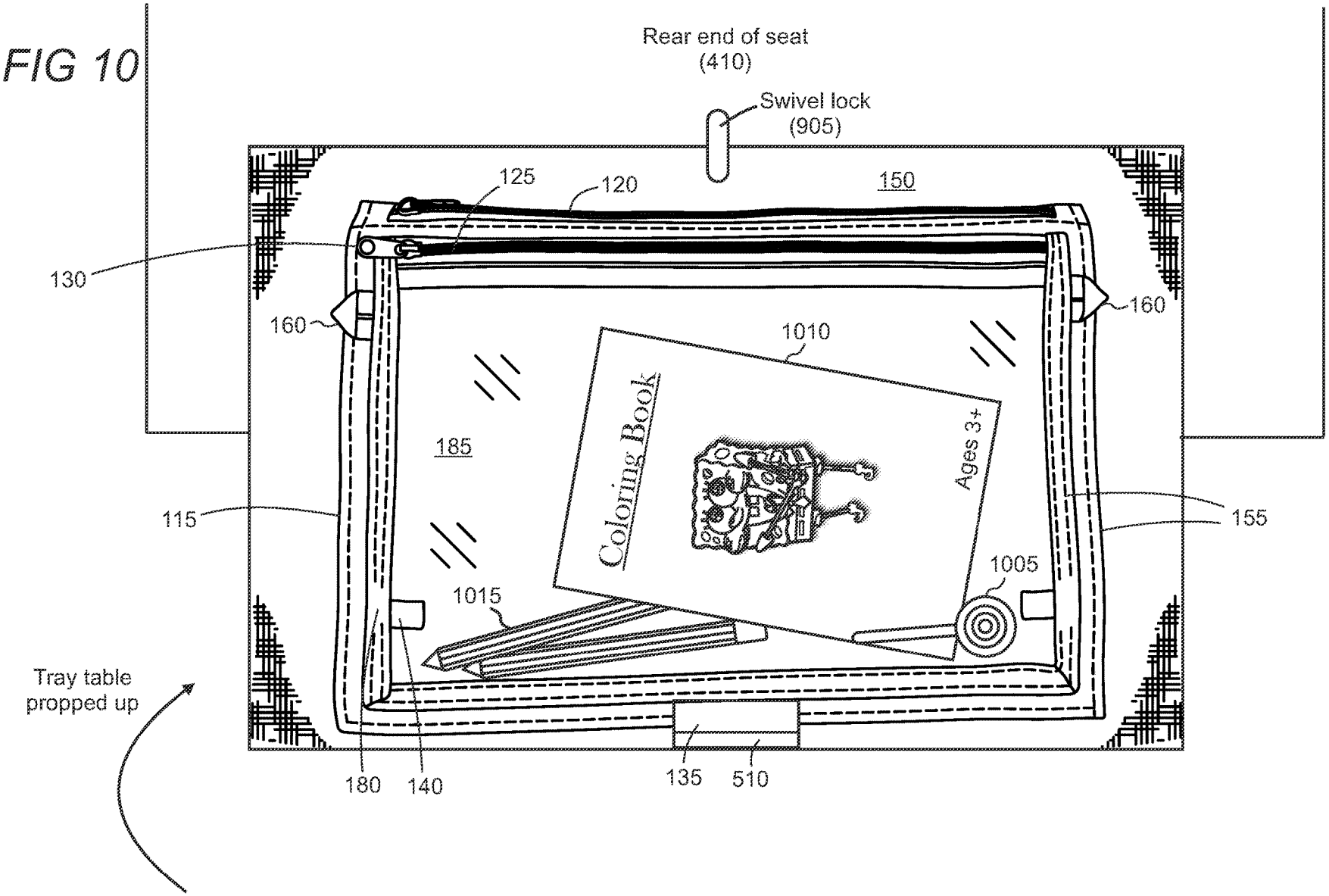
FIG. 10 shows an illustrative representation of the tray table in a closed position and the transparent pocket on the sleeve's underside having various toys for a child.

FIGS. 9 and 10 show illustrative environments in which the prop-up tray 110 has been detached from the sleeve 115 and the tray table 405 has been propped up against the front seat 410 using, for example, a swivel lock 905. The sleeve's designs and configurations enable the sleeve to stay secured to the tray table even when in the closed position. Specifically, the relatively thin and malleable material allows the sleeve to fit between the closed tray table and the front seat 410 it is attached to. The user can at least view their tablet computer 905 through the transparent exterior film 185 on the lower pouch 125. The user may also be able to operate a device's touch screen through the transparent exterior film without removing the device from the pouch. Thus, the user can watch various multimedia, such as movies, shows, clips, music videos, etc., while on the flight and their device is protected in the pouch. In this illustrative example, the user can provide input 910 on the device's touchscreen display to play the movie Shrek®.

In other implementations, such as in FIG. 10, the user may store various items in their sleeve's pouches 120, 125, such as a coloring book 1010, writing utensils 1015, lollypop 1005 or other candy, among other items. FIGS. 9 and 10 also illustratively show the hook-and-loop connection between the base 135 and closing strap 510, which can further tighten the sleeve to a tray table to accommodate various sizes. The closing strap 510 extends around the tray table and onto the opposite side of the sleeve to engage with the base 135.

Figure 11:
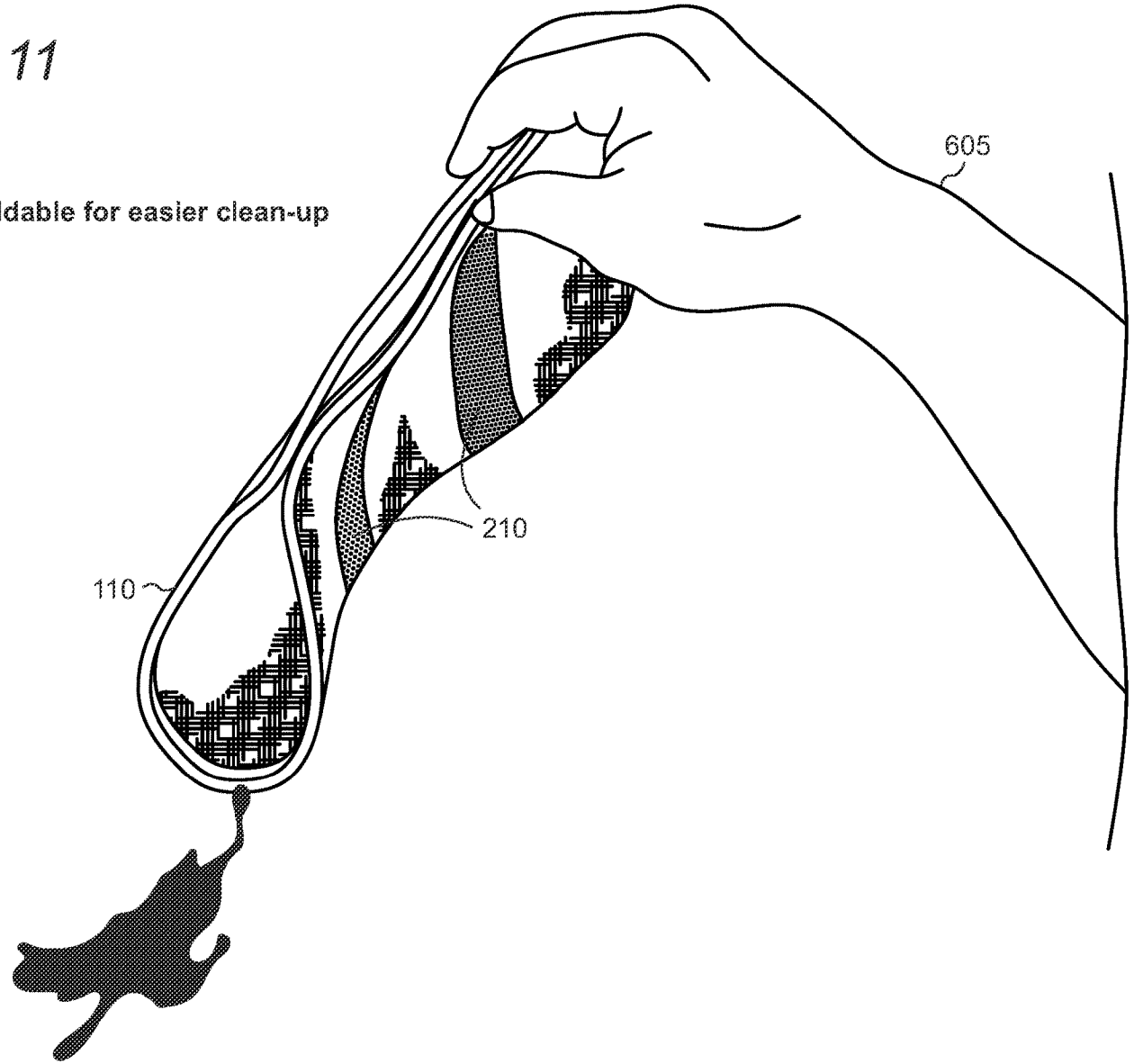
FIG. 11 shows an illustrative representation of the prop-up tray's foldability to clean up spills.

FIG. 11 shows an illustrative representation in which the prop-up tray 110 is easily foldable to provide an easy clean-up. For example, spills on the push-up tray's water-resistant material help the water or other liquid pool on the top surface instead of soaking through. This allows a user the ability to pick up the prop-up tray, fold it as such, and pour the contents into a sink or garbage for an easy clean-up. Furthermore, the tray table cover 105 can be wiped down with a wet or dry rag or paper towel, and is also durable enough to be washed in the washing machine under certain washing cycles.

Figure 12:
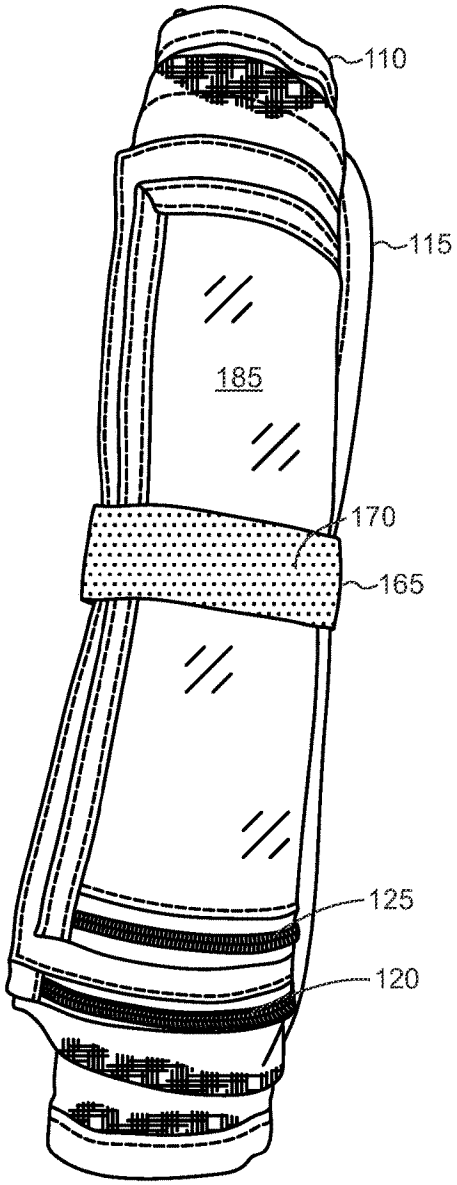
FIG. 12 shows an illustrative representation of the tray table cover fully rolled up and locked in place via a strap that extends around the entire cover.

FIG. 12 shows an illustrative representation in which the tray table cover 105 has been rolled up into a cylindrical shape for easy storage. The user can wrap the strap 165 around the rolled-up cover, then attach the corresponding hook and loop fasteners 170 and 175. Put simply, the fastener 175 engages with the corresponding fastener 170 on the strap 165. Since the strap's hook and loop fasteners 170 and 175 are on both sides, the user can fold the strap in either direction. Furthermore, the tray table cover can be rolled up in either direction as well, such as the sleeve's pouches positioned in the center and the prop-up tray 110 positioned on the outside when rolled up. In such a conveniently compact state, the user could opt to use one of the loops 160 to hook the tray table cover 105 to their luggage, backpack, etc.

In alternative implementations, the prop-up tray 110 may be permanently attached to the sleeve 115. For example, the two parts may be permanently sewn and/or glued together to create a single non-detachable item. Furthermore, the sleeve may further comprise side straps for further tightening to the tray table. These side straps may consist of Velcro® straps, ladder-lock buckles, drawstring straps, etc., to provide an even more snug fit with the tray table 405.

As the tray table cover 105 may be purchased by parents for their children, its exterior appearance may come in various colors, patterns, and designs. For example, the pouch body 155, sleeve body 150, and prop-up tray may have designs such as airplanes, buses, trucks, dinosaurs, animals, fairies, mermaids, princesses, etc. An adult version may come in more generic colors like black, blue, green, etc.

Various exemplary embodiments are disclosed herein. In one exemplary embodiment, disclosed is a tray table cover, comprising: a sleeve having an opening adapted to at least partially encapsulate a tray table, wherein the sleeve has a fastener on a top side thereof; and a prop-up tray having a corresponding fastener on a bottom side thereof, in which the corresponding fastener engages with the sleeve's fastener, and wherein the prop-up tray includes sets of fasteners on each corner that, upon connecting each set of fasteners, props sides of the prop-up tray upward to create an exterior barrier.

In another example, the sleeve is at least partially comprised of a stretchable fabric, including spandex. As another example, the fastener on the top side of the sleeve is a hook-and-loop fastener. As another example, the sleeve has attachment mechanisms on opposing sides to enable a user to at least partially close the opening when secured to the tray table. In another example, the sets of fasteners on the prop-up tray's corners are any one or more of buttons, tab and notch, or hook-and-loop. As another example, at least a top surface of the prop-up tray is comprised of a water-resistant material. In another example, a bottom side of the sleeve includes one or more pouches. In another example, a transparent pouch of the one or more pouches has a transparent film on its exterior to enable a user to see through the pouch and thereby the pouch's contents. As another example, a computing device is stored within the transparent pouch, thereby exposing the computing device's display screen. As another example, when the tray table is in a closed position and a latch is positioned over the tray table, the sleeve maintains its position on the tray table and the latch overlaps with the sleeve to secure the tray table in the closed position.

In another exemplary embodiment, disclosed is a method of securing a tray table cover to a tray table, comprising: providing a sleeve having an opening adapted to at least partially encapsulate a tray table, wherein the sleeve has a fastener on a top side thereof; advancing the tray table cover around the tray table to at least partially encapsulate the tray table; attaching a prop-up tray's corresponding fastener to the sleeve's fastener, the prop-up tray's corresponding fastener positioned on a bottom side thereof, providing sets of fasteners on each corner of the prop-up tray; and connecting each respective set of fasteners on the prop-up tray's corners, and, upon connecting each set of fasteners, sides of the prop-up tray prop upward relative to the prop-up tray's flat base to create an exterior barrier to a center area of the prop-up tray.

As another example, the sleeve is comprised of a stretchable fabric, including spandex. In a further example, the fastener on the top side of the sleeve is a hook-and-loop fastener. As another example, the sleeve has attachment mechanisms on opposing sides to enable a user to at least partially close the opening when secured to the tray table. As another example, the sets of fasteners on the prop-up tray's corners are any one or more of buttons, tab and notch, or hook-and-loop. In another example, at least a top surface of the prop-up tray is comprised of a water-resistant material. As another example, a bottom side of the sleeve includes one or more pouches. In another example, a transparent pouch of the one or more pouches has a transparent film on its exterior to enable a user to see through the pouch and thereby the pouch's contents. As another example, a computing device is stored within the transparent pouch, thereby exposing the computing device's display screen. In a further example, a closing strap attached to the prop-up tray, wherein the closing strap has hook-and-loop fasteners on each side thereof to enable a user to wrap the closing strap around the tray table cover in either direction.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed:

1. A tray table cover, comprising:

a sleeve having an opening adapted to at least partially encapsulate a tray table, wherein the sleeve has a fastener on a top side thereof and a pouch on a bottom side thereof to enable a user to access the pouch's contents when the tray table is in an upright closed position, wherein the sleeve is unitary and is sealed at three sides thereof and the opening is on its fourth side; and a prop-up tray having a corresponding fastener on a bottom side thereof, in which the corresponding fastener engages with the sleeve's fastener such that the sleeve, when the tray table is in a use position simultaneously engages and encapsulates the tray table while the prop-up tray is removably attachable to the sleeve, and wherein the prop-up tray includes sets of fasteners on each corner that, upon connecting each set of fasteners, props sides of the prop-up tray upward to create an exterior barrier while simultaneously being removably attachable to the sleeve, and wherein the prop-up tray covers a larger surface area relative to the sleeve, such that the prop-up tray, when its sets of fasteners are unfastened, extends beyond a perimeter of the sleeve.

2. The tray table cover of claim 1, wherein the sleeve is at least partially comprised of a stretchable fabric, including spandex.

3. The tray table cover of claim 1, wherein the fastener on the top side of the sleeve is a hook-and-loop fastener.

4. The tray table cover of claim 1, wherein the sleeve has attachment mechanisms on opposing sides of the sleeve's opening to enable a user to at least partially close the opening when secured to the tray table.

5. The tray table cover of claim 1, wherein the sets of fasteners on the prop-up tray's corners are any one or more of buttons, tab and notch, or hook-and-loop.

6. The tray table cover of claim 1, wherein at least a top surface of the prop-up tray is comprised of a water-resistant material.

7. The tray table cover of claim 1, further comprising a transparent pouch which has a transparent film on its exterior to enable a user to see through the transparent pouch and thereby its contents.

8. The tray table cover of claim 7, wherein a computing device is stored within the transparent pouch, thereby exposing the computing device's display screen.

9. The tray table cover of claim 1, wherein, when the tray table is in the upright closed position and a latch is positioned over the tray table, the sleeve maintains its position on the tray table and the latch overlaps with the sleeve to secure the tray table in the closed position.

10. A method of securing a tray table cover to a tray table, comprising:

providing a sleeve having an opening adapted to at least partially encapsulate a tray table, wherein the sleeve has a fastener on a top side thereof and a pouch on a bottom side thereof to enable a user to access the pouch's contents when the tray table is in an upright closed position, wherein the sleeve is unitary and is sealed at three sides thereof and the opening is on its fourth side;

advancing the tray table cover around the tray table to at least partially encapsulate the tray table;

attaching a prop-up tray's corresponding fastener to the sleeve's fastener, the prop-up tray's corresponding fastener positioned on a bottom side thereof, such that the sleeve, when the tray table is in a use position, simultaneously engages and encapsulates the tray table while the prop-up tray is removably attachable to the sleeve providing sets of fasteners on each corner of the prop-up tray; and connecting each respective set of fasteners on the prop-up tray's corners, and, upon connecting each set of fasteners, sides of the prop-up tray prop upward relative to the prop-up tray's flat base to create an exterior barrier to a center area of the prop-up tray, while the prop-up tray is simultaneously removably attachable to the sleeve wherein the prop-up tray covers a larger surface area relative to the sleeve, such that the prop-up tray, when its sets of fasteners are unfastened, extends beyond a perimeter of the sleeve.

11. The tray table cover of claim 10, wherein the sleeve is comprised of a stretchable fabric, including spandex.

12. The tray table cover of claim 10, wherein the fastener on the top side of the sleeve is a hook-and-loop fastener.

13. The tray table cover of claim 10, wherein the sleeve has attachment mechanisms on opposing sides to enable a user to at least partially close the opening when secured to the tray table.

14. The tray table cover of claim 10, wherein the sets of fasteners on the prop-up tray's corners are any one or more of buttons, tab and notch, or hook-and-loop.

15. The tray table cover of claim 10, wherein at least a top surface of the prop-up tray is comprised of a water-resistant material.

16. The tray table cover of claim 10, further comprising a transparent pouch which has a transparent film on its exterior to enable a user to see through the transparent pouch and thereby its contents.

17. The tray table cover of claim 16, wherein a computing device is stored within the transparent pouch, thereby exposing the computing device's display screen.

18. The tray table cover of claim 10, further comprising a closing strap attached to the prop-up tray, wherein the closing strap has hook-and-loop fasteners on each side thereof to enable a user to wrap the closing strap around the tray table cover in either direction.

* * * * *